US008795035B2

(12) United States Patent
Wu et al.

(10) Patent No.: US 8,795,035 B2
(45) Date of Patent: Aug. 5, 2014

(54) CHEMICAL MECHANICAL PLANARIZATION PAD CONDITIONER AND METHOD OF FORMING

(75) Inventors: Jianhui Wu, Westborough, MA (US); Gilles Querel, Worcester, MA (US); Eric Schulz, Worcester, MA (US); Richard W. J. Hall, Southborough, MA (US)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 900 days.

(21) Appl. No.: 12/491,929

(22) Filed: Jun. 25, 2009

(65) Prior Publication Data

US 2009/0325472 A1 Dec. 31, 2009

Related U.S. Application Data

(60) Provisional application No. 61/075,966, filed on Jun. 26, 2008.

(51) Int. Cl.
*B24B 53/02* (2012.01)

(52) U.S. Cl.
USPC ..... 451/443; 451/287; 451/290

(58) Field of Classification Search
USPC ..... 451/56, 285, 287, 290, 443, 6; 51/307
See application file for complete search history.

(56) References Cited

U.S. PATENT DOCUMENTS

| | | | | |
|---|---|---|---|---|
| 3,982,911 | A * | 9/1976 | Lee | 51/307 |
| 4,951,888 | A * | 8/1990 | Sharpe et al. | 241/296 |
| 5,633,084 | A * | 5/1997 | Hiraiwa et al. | 428/403 |
| 6,004,362 | A * | 12/1999 | Seals et al. | 51/295 |
| 7,179,507 | B2 * | 2/2007 | Fiala et al. | 427/455 |
| 7,300,338 | B2 | 11/2007 | Wielonski et al. | |
| 2003/0109204 | A1 * | 6/2003 | Sung | 451/56 |
| 2004/0229464 | A1 * | 11/2004 | Godfried et al. | 438/689 |
| 2006/0234610 | A1 | 10/2006 | Kramer | |
| 2008/0004743 | A1 * | 1/2008 | Goers et al. | 700/121 |
| 2008/0207089 | A1 * | 8/2008 | Lehman et al. | 451/6 |
| 2012/0100787 | A1 * | 4/2012 | Sung | 451/56 |
| 2013/0273820 | A1 * | 10/2013 | Sung | 451/443 |

FOREIGN PATENT DOCUMENTS

| | | | | |
|---|---|---|---|---|
| JP | 03079277 | A * | 4/1991 | B24D 3/18 |
| JP | 04322972 | A * | 11/1992 | B24D 3/18 |
| JP | 09267265 | A * | 10/1997 | B24D 3/14 |
| JP | 11283944 | A * | 10/1999 | H01L 21/304 |

(Continued)

OTHER PUBLICATIONS

University of Michigan, "Coefficient of Thermal Expansion (Linear)," Apr. 1996, Biomaterials Properties Database, University of Michigan, Quintessence Publishing, 3 pages.

(Continued)

*Primary Examiner* — Eileen P. Morgan

(74) *Attorney, Agent, or Firm* — Joseph P. Sullivan; Abel Law Group, LLP

(57) ABSTRACT

A CMP pad conditioner including a substrate having a transparency window represented by an average internal transmittance of not less than about 90% over a wavelength range extending from about 400 nm to about 500 nm along a path length extending through the substrate of not less than about 10 mm a bonding layer overlying a surface of the substrate, and abrasive grains contained within the bonding layer.

17 Claims, 3 Drawing Sheets

(56) References Cited

FOREIGN PATENT DOCUMENTS

| | | | |
|---|---|---|---|
| JP | 2001-239449 | A | 9/2001 |
| JP | 2006-055943 | A | 3/2006 |
| WO | 02-49807 | A1 | 6/2002 |
| WO | 2004/086477 | A1 | 10/2004 |
| WO | 2005-095059 | A1 | 10/2005 |

OTHER PUBLICATIONS

Chart of COE's Coefficient of Thermal Expansion, Lucas-Milhaupt, Inc., 2006, 3 pages. <http://www.lucasmilhaupt.com/htmdocs/brazing_support/index.html>.

Accuratus, "Aluminum Oxide, Al2O3," Aluminum Oxide (Al2O3) Properties, 2002, 4 pages. <http://accuratus.com/alumox.html>.

* cited by examiner

CHEMICAL MECHANICAL PLANARIZATION PAD CONDITIONER AND METHOD OF FORMING

CROSS-REFERENCE TO RELATED APPLICATION(S)

The present application claims priority from U.S. Provisional Patent Application No. 61/075,966, filed Jun. 26, 2008, entitled "Chemical mechanical planarization pad conditioner and method of forming," naming inventors Richard W. J. Hall, Jianhui Wu and Eric Schulz, which application is incorporated by reference herein in its entirety.

BACKGROUND

1. Field of the Disclosure

The following application is directed to a CMP pad conditioner, and more particularly to a CMP pad conditioner utilizing a ceramic, glass, or glass-ceramic substrate and a vitreous bonding layer.

2. Description of the Related Art

In the fabrication of electronic device, multiple layers of various types of material are deposited including for example conducting, semiconducting, and dielectric materials. Successive deposition or growth and removal of various layers results in a non-planar upper surface. A wafer surface that is not sufficiently planar will result in structures that are poorly defined, with the circuits being nonfunctional or exhibiting less than optimum performance. Chemical mechanical planarization (CMP) is a common technique used to planarize or polish workpieces such as semiconductor wafers.

During a typical CMP process a workpiece is placed in contact with a polishing pad and a polishing slurry is provided on the pad to aid in the planarization process. The polishing slurry can include abrasive particles which may interact with the workpiece in an abrasive manner to remove materials, and may also act in a chemical manner to improve the removal of certain portions of the workpiece. The polishing pad is typically much larger than the workpiece, and is generally a polymer material that can include certain features, such as micro-texture suitable for holding the slurry on the surface of the pad. Moreover, during a polishing operation, a pad conditioner is typically employed to move over the surface of the polishing pad to clean the polishing pad and properly condition the surface to hold slurry.

Polishing pad conditioning is important to maintaining a desirable polishing surface for consistent polishing performance, since over time the polishing surface of the polishing pad wears down, smoothing over the micro-texture of the polishing surface. Additionally, debris from the CMP process can clog the micro-channels through which slurry flows across the polishing surface. Conventional polishing pad conditioning is achieved by abrading the polishing surface mechanically with a pad conditioner, typically consisting of a metal substrate, a brazed metallic bonding layer and diamonds or other abrasive particles held within the bonding layer. However, such conventional conditioners have problems, including geometry irregularities, abrasive grain "pull out", and chemical corrosion of the bonding layer.

Accordingly, the industry continues to demand improved CMP pad conditioners and methods of forming thereof.

SUMMARY

According to one aspect, a CMP pad conditioner includes substrate having a transparency window represented by an average internal transmittance of at least about 90% over a wavelength range extending from about 400 nm to about 500 nm along a path length extending through the substrate of not less than about 10 mm, a bonding layer overlying a surface of the substrate, and abrasive grains contained within the bonding layer. In certain particular instances, the substrate includes an amorphous phase, such that it is made of a glass.

In another aspect, a CMP pad conditioner can include a substrate comprising an amorphous phase, a bonding layer comprising a vitreous material overlying and bonded to a major surface of the substrate, and abrasive grains contained within the vitreous bond layer. Notably, the upper surface of the bonding layer defines an upper plane having a flatness of less than about 50 microns. In particular instances the flatness is less, such as not greater than about 30 microns, and even not greater than about 10 microns.

In another aspect, a method of forming a CMP pad conditioner includes providing a substrate comprising an amorphous phase, placing a frit-containing material over a major surface of the substrate, placing abrasive grains within the frit-containing material, and heating the substrate, frit-containing material, and abrasive grains to a forming temperature of less than about 1000° C. to form a CMP pad conditioner having a vitreous bonding layer. In particular the forming temperature is within a range between about 500° C. and about 1000° C.

A CMP pad conditioner includes a substrate comprising an oxide, a bonding layer comprising a vitreous material overlying and bonded to a major surface of the substrate, and abrasive grains contained within the bonding layer, wherein the abrasive grains comprise a core material and a coating overlying the core material.

According to yet another aspect, a CMP pad conditioner includes a substrate comprising a material selected from the group of materials consisting of ceramics, glasses, and a combination thereof. The CMP pad conditioner further includes a bonding layer comprising a vitreous material overlying and bonded to a major surface of the substrate and abrasive grains contained within the bonding layer. The substrate has a coefficient of thermal expansion (CTE) and the bonding layer has a CTE and the difference between the CTE of the substrate and the CTE of the bonding layer is not greater than about 5 microns/m° C.

BRIEF DESCRIPTION OF THE DRAWINGS

The present disclosure may be better understood, and its numerous features and advantages made apparent to those skilled in the art by referencing the accompanying drawings.

The use of the same reference symbols in different drawings indicates similar or identical items.

DETAILED DESCRIPTION

The following description is directed to embodiments of a CMP pad conditioner having components made of non-metallic parts. In particular, the following description provides a detailed method of forming a conditioner as well as description regarding particular features of the CMP pad conditioner.

Figure 1:
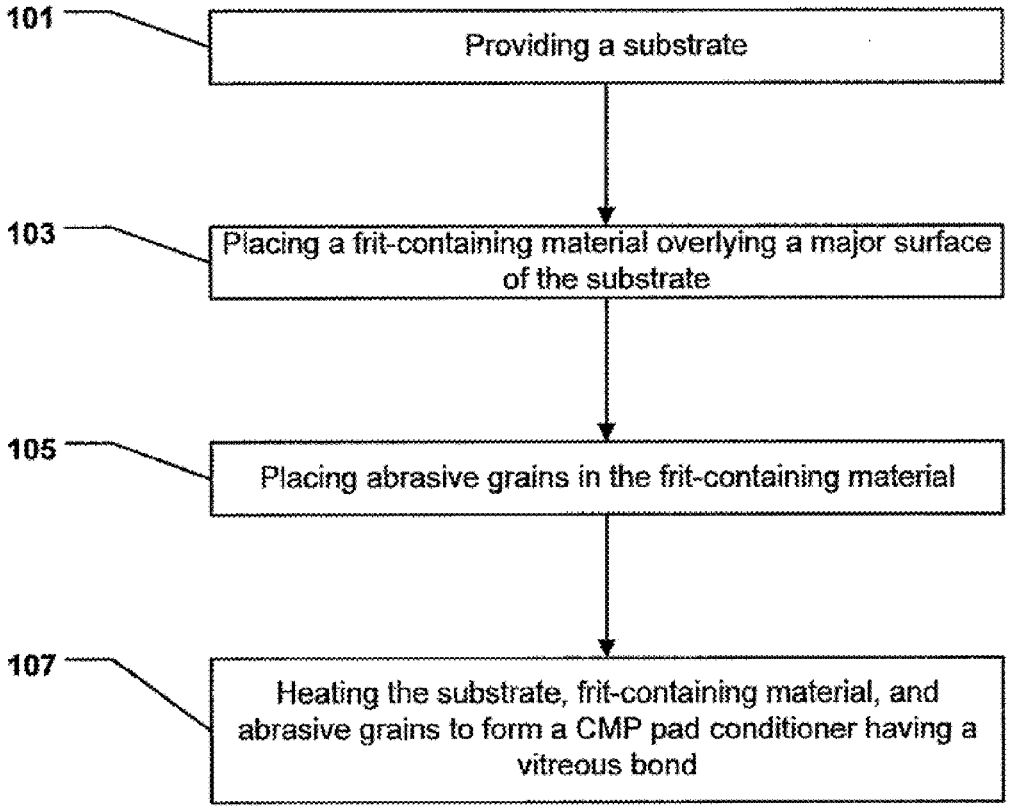
FIG. 1 includes a flow chart illustrating a method of forming a CMP pad conditioner in accordance with an embodiment.

FIG. 1 includes a flow chart illustrating a method of forming a CMP pad conditioner in accordance with an embodiment. As illustrated, the process is initiated at step 101 by providing a substrate. The substrate provides a base structure upon which component layers can be subsequently formed to make the final CMP pad conditioner. In certain instances, the substrate can have a disk shape. The substrate can include a rear surface and a top surface which are co-planar surfaces spaced apart from each other and joined by sides. The top surface generally provides a suitable surface having a particular geometry for formation of component layers thereon. It will be appreciated, however that other shapes may be suitable depending upon the intended application of the CMP pad conditioner and the tool the conditioner is intended to interface with.

In accordance with one embodiment, the substrate can be made of an inorganic material, such as a glass, ceramic, or a combination thereof. In certain instances, the substrate can include a polycrystalline phase. For example, the substrate can be made of a polycrystalline material, such that a majority content of the substrate by volume is made of the polycrystalline phase. According to one particular embodiment, the substrate is formed such that it consists essentially of a polycrystalline material. In still other designs, the substrate can incorporate an amorphous phase material (e.g., glass). In fact, according to particular designs, the substrate can be formed such that a majority content of the substrate by volume is made of the amorphous phase, or even more particularly the substrate can consist essentially of an amorphous phase material, such that in certain embodiments, the substrate is made of a glass material.

In certain embodiments, the substrate can be formed of an oxide material. Suitable oxide materials can include metal oxides, such as silica, alumina, zirconia, titania, and a combination thereof. For example, in one particular embodiment, the substrate can be formed of fused silica, particularly for those embodiments utilize an amorphous phase. It will be appreciated that reference to fused silica includes fused quartz materials as well. Still, other substrate designs can be made of alumina, such that in particular instances, the substrate consists essentially of alumina.

According to one aspect, the CMP pad conditioner is made of a substrate that has a transparency window. A substrate having a transparency window, particularly within the visible spectrum, facilitates the formation of a CMP pad conditioner in which an operator can monitor the bonding layer or potentially the conditioning operation. Additionally, such a substrate can also be used with other optical monitoring systems, such as Laser Doppler Velocimetry (LDV), in which a laser or set of lasers are directed through the substrate and focused on the conditioning work surface to monitor the fluid flow and particle flow dynamics. Generally, the transparency window is represented by a percent (internal) transmittance over a wavelength range extending from about 400 nm to about 500 nm. In certain embodiments, the transparency window is larger, spanning a greater portion of the spectrum, such as within a range between about 300 nm to about 600 nm, and more particularly over the range of visible light from about 300 nm to about 700 nm. In fact, in certain embodiments, the transparency window extends into the ultraviolet portion of the spectrum, for example, as low as 200 nm and can cover a range as broad as between about 200 nm to about 1000 nm.

The transparency window may be defined by the average value of internal transmittance along a path length of 10 mm through the material of the substrate. As such, in one embodiment, the substrate has an average internal transmittance of at least about 90%. Other substrates can have a greater average internal transmittance, such as at least about 95%, such as at least about 97%, and in some particular instances at least about 99% over the range of wavelengths in the transparency window. In fact, in some instances, the internal transmittance curve across the transparency window is particularly flat, such that the substrate material exhibits consistent transmittance properties across the range of wavelengths. It will be appreciated that the path length (10 mm) is a testing parameter to define the internal transmittance for a material of the substrate, and may not necessarily be a dimension of the substrate. The internal transmittance values were derived by testing polished samples having a thickness of 10 mm using a PerkinElmer Lambda 800 Spectrophotometer for UV-Visible wavelengths, and a Mattson Polaris FTIR Spectrophotometer for IR wavelengths.

Prior to the formation of other component layers and the formation of the CMP pad conditioner, the substrate can undergo procedures to prepare the substrate for later processes. For example, in one embodiment, a major surface of the substrate can be ground and/or polished to clean the work surface of the substrate for further processing and give the surface suitable geometric features, such as roughness and flatness. As such, in one particular embodiment, the major surface of the substrate is ground and/or polished such that after, the upper major surface has a flatness that is not greater than about 50 microns. In accordance with other certain embodiments, the major surface of the substrate can have a flatness that is less than about 40 microns, less than about 30 microns, or more particularly within a range between about 1 micron and 40 microns after grinding and/or polishing.

In addition to having a flat upper surface suitable for forming layers thereon and the production of a final-formed device having certain geometric features, the substrate can have a particular parallelism. That is, the major front surface where component layers can be formed and a back surface can have a parallelism that is not greater than about 10 arc minutes. In more particular embodiments, the front surface and the back surface demonstrate greater parallelism, such as not greater than about 8 arc minutes, or even not greater than about 5 arc minutes.

The substrate can have an average thickness that is suitable for providing the rigidity to form component layers thereon. As such, the average thickness of the substrate according to one embodiment is not greater than about 25 mm. In certain other embodiments, the thickness can be less, such as not greater than about 20 mm, not greater than about 15 mm, or even not greater than about 10 mm. According to one particular embodiment, the average thickness of the substrate is within a range between about 5 mm and about 15 mm, such as within a range between about 8 mm and about 13 mm.

Other processes can be undertaken to prepare the substrate. For example, in some instances, openings or engagement holes can be formed within the substrate such that the substrate is properly fitted for engagement with the CMP tool. Generally, such engagement holes or openings may be formed along the sides proximate to the rear surface of the substrate. Additionally, engagement holes can be formed within the rear surface of the substrate opposite the front surface for coupling with portions of a CMP tool.

After providing the substrate at step 101, the process continues at step 103 by placing a frit-containing material overlying a major surface of the substrate. Generally, the frit-containing material forms a vitreous bonding layer overlying the major surface of the substrate in the final-formed CMP pad conditioner and is used to bond the abrasive grains to the substrate.

In accordance with one embodiment, placing of the frit-containing material on the major surface of the substrate can include depositing a layer of frit-containing material over the surface of the substrate. In certain instances, the frit-containing material can be in the form of a powder. Adhesive materials may be used to facilitate placement of the frit-containing material on the surface of the substrate, until further processing. According to certain other embodiments, the frit-containing material can be supplied in the form of a paste or tape, utilizing a vehicle for carrying the frit-containing material. Generally, the vehicle can include an organic compound that will evolve as a gas or "burn off" during later processing.

The frit-containing material is generally an oxide material. In certain examples, the frit-containing material includes silica, and in fact, can contain a majority amount of silica. Other oxides can be included within the frit-containing material such as sodium oxide, aluminum oxide, magnesium oxide, calcium oxide, combinations thereof and the like. Notable frit-containing compounds include boron oxide. For example, in one embodiment the frit-containing material contains at least about 1 wt %, such as at least about 5 wt %, or even at least about 10 wt % boron oxide. In another particular embodiment however, the frit-containing material contains not greater than about 30 wt % boron oxide, such as not greater than about 25 wt % boron oxide, and can be within a range between about 1 wt % and 30 wt %, and more particularly within a range between about 5 wt % and 25 wt %. Such borosilicate frit-containing materials have suitable coefficients of thermal expansion for use with substrates described herein and facilitate ease of formation of such CMP pad conditioners.

After placing the frit-containing material over the substrate at step 103, the process continues at step 105 by placing abrasive grains in the frit-containing material. Placement of abrasive grains within the frit-containing material facilitates the formation of a CMP pad conditioner in which the abrasive grains are bonded within a final-formed vitreous bonding layer, which is a product of the frit-containing material overlying the substrate. Placement of the abrasive grains may be done such that the grains are placed in a monolayer within the frit-containing material. In certain instances, the abrasive grains may be placed within the frit-containing material in a two-dimensional pattern or array. For example, abrasive grains may be arranged in a pattern representing a polygonal shape such as a triangle or hexagonal shape. Alternatively, the abrasive grains may be arranged in the frit-containing material in a self-avoiding random distribution (SARD™).

Certain embodiments utilize abrasive grains that can include oxides, carbides, borides, nitrides, and a combination thereof. More particularly, the abrasive grains can be superabrasive materials, for example diamond or cubic boron nitride. Generally, the abrasive grains have a size that is less than about 250 microns. In certain embodiments, the abrasive grains may be smaller, such that the average grains size is less than about 200, such as less than about 150 microns, less than 100 microns, and more particularly within a range between about 1 micron and 150 microns.

In certain designs, the abrasive grains can be coated abrasive grains that incorporate a core material and a coating overlying the core material. Suitable examples of core materials can include oxides, carbides, borides, nitrides, and a combination thereof. In particular instances, the core material can include a superabrasive material, such as diamond or cubic boron nitride.

The coating material can include an inorganic material. Some examples of suitable inorganic materials can include a metal or metal alloy material. For example, certain abrasive grains may utilize transition metal or transition metal alloys. Particularly suitable transition metals can include titanium, nickel, tungsten, and a combination thereof. In accordance with one certain embodiment, the coating material consists essentially of titanium.

In still other embodiments, the coating material can include an inorganic, ceramic material, such as oxides, carbides, nitrides, borides, and a combination thereof. More particularly, the coating can be made oxides, such as titanium oxide, aluminum oxide, silicon dioxide, boron oxide, zirconium oxide, and the like. It will be appreciated, that the coating can include a combination of oxides.

Moreover, the coating can be formed such that it overlies a majority of the external surface of the core material of each of the abrasive grains. In fact, certain embodiments can use a coating that overlies a greater percentage of the core material, such as at least about 75%, such as at least about 80%, at least about 85%, at least about 90%, or even at least about 95% of the external surface of the core material. In particular instances, the coating can overlie essentially the entire external surface of the core material of each of the abrasive grains.

The abrasive grains can be placed in the frit-containing material in a random arrangement, such that there is no short-range or long-range order to the distribution of the abrasive grains across the surface of the substrate. In other words, the abrasive grains may not necessarily be arranged on the surface of the substrate such that they are uniformly spaced apart in a regular pattern. In fact, particular embodiments may utilize a self-avoiding random distribution (SARD™) arrangement of abrasive grains along the surface of the substrate.

In still other designs, the abrasive grains can be placed on the frit-containing material in a regular, ordered pattern. That is, the grains can form patterns having short range order relative to each other in a locality on the surface of the article, or even demonstrate long range order of a regular, repeating array across the entire area of the article. Certain patterns can include diamond-shaped patterns, rectangular-shaped patterns, and other polygonal-based patterns.

After placing the abrasive grains in the frit-containing material at step 105, the process of forming the pad conditioner continues at step 107 wherein the substrate, frit-containing material, and abrasive grains are heated to a forming temperature. In particular, heating facilitates the transformation of the frit-containing material to a vitreous bonding material and securing the abrasive grains within the vitreous bonding layer.

The heating process utilizes a forming temperature suitable for forming the vitreous bonding layer while minimizing the physical deformation of the components (i.e., substrate, bonding layer, and abrasive grains) in the form of warp, bow, and the like. In accordance with certain embodiments, the forming temperature is less than 1000° C., such as not greater than about 950° C., not greater than about 900° C., not greater than about 850° C., or even not greater than about 800° C. In one particular embodiment, the forming temperature is within a range between about 500° C. and 1000° C.

The heating process can further include a controlled heating rate to reach the forming temperature. According to embodiments herein, the heating rate can be not less than about 1° C./min., such as not less than about 2° C./min., not less than about 3° C./min., and particularly within a range between about 1° C./min., and about 10° C./min., or more particularly between about 1° C./min and about 5° C./min.

The atmosphere used during heating can be an inert atmosphere to reduce the oxidation of the abrasive particles. Accordingly, certain embodiments utilize a noble gas such as argon, or a combination of noble gases. Alternatively, other inert species can be used, such as nitrogen. Certain embodiments herein may utilize particular types of abrasive grains, that may facilitate conducting the heating process in an natural (air) atmosphere. For example, in particular instances, coated abrasive grains having a core material and an overlying coating may be used, and in such instances, the heating operation may be carried out in air.

After reaching the forming temperature, the as-formed CMP pad conditioner can be held at the forming temperature for a duration sufficient to form the vitreous material from the frit-containing material while minimizing physical deformation to the components. According to particular embodiments utilizing amorphous phase substrates, the holding duration at the forming temperature is not less than 30 minutes. In other embodiments, the duration may be longer, such as not less than about 45 minutes, or not less than about 60 minutes. Still, the duration is not greater than about 90 minutes, and particularly within a range between about 30 minutes and 90 minutes.

In other embodiments, such as those utilizing a substrate having a polycrystalline phase, such as ceramic or glass-ceramic materials, the holding duration may be longer. For example, the holding duration can be at least about 180 minutes, such as at least about 200 minutes, at least about 240 minutes, at least about 300 minutes, or even at least about 360 minutes. Particular embodiments may utilize a holding duration within a range between about 180 minutes and about 480 minutes, such as between about 200 minutes and about 360 minutes, and more particularly between about 220 minutes and about 300 minutes.

After holding the components at a temperature for a duration sufficient to form a vitreous bonding layer, the article may be cooled. Cooling can be a controlled operation to maintain the vitreous phase in bonding layer. For example, in certain embodiments, the cooling rate is not greater than about 5° C./min., such as not greater than about 3° C./min., or even not greater than about 2° C./min.

Figure 2:
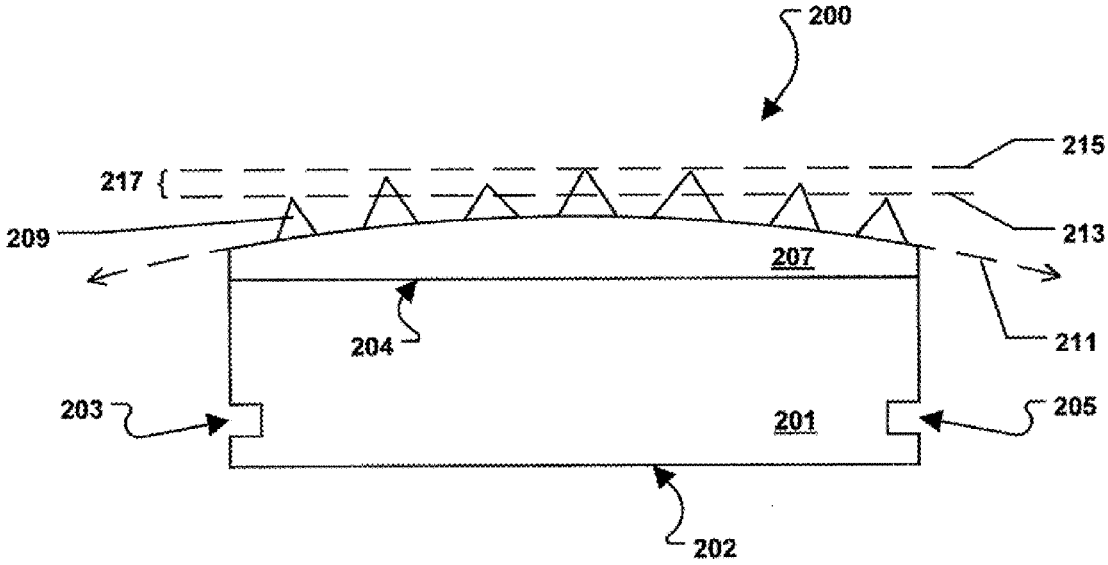
FIG. 2 includes a cross-sectional illustration of a CMP pad conditioner in accordance with an embodiment.

Referring to FIG. 2, a cross-sectional illustration of a CMP pad conditioner is illustrated in accordance with an embodiment. As illustrated, the CMP pad conditioner 200 includes a substrate 201. As further illustrated, the substrate 201 can include openings 203 and 205 proximate to the rear surface 202 of the substrate 201, which facilitate engagement of the CMP pad conditioner 200 with a CMP tool.

In accordance with one particular embodiment, the substrate 201 is formed of a material having a coefficient of thermal expansion (CTE) of not greater than about 10 microns/m° C. Provision of a substrate 201 having a certain CTE facilitates the formation of the CMP pad conditioner and also improves the geometric characteristics of the conditioner (e.g., flatness, bow and warp) resulting in more uniform conditioning of a CMP pad. In other particular embodiments, the CTE of the substrate 201 can be less, such as not greater than about 9 microns/m° C., not greater than about 8 microns/m° C., and more particularly within a range between about 0.1 microns/m° C. and about 10 microns/m° C. It will be appreciated that reference to such CTE values are generally measured for such materials over a range from 0° C. to 300° C.

The CMP pad conditioner 200 further includes a bonding layer 207 made of a vitreous material. For example, the bonding layer can have a coefficient of thermal expansion (CTE) of not greater than about 10 microns/m° C. In certain other embodiments, the CTE of the bonding layer 207 is less, such as not greater than about 8 microns/m° C., not greater than about 5 microns/m° C., or even not greater than about 3 microns/m° C. In accordance with a particular embodiment, the bonding layer 207 has a CTE within a range between about 0.1 micron/m° C. and about 10 microns/m° C.

A notable aspect of the CMP pad conditioner 200 is that it is formed such that the substrate 201 and bonding layer 207 have closely matching coefficients of thermal expansion. In particular, the small difference between the CTE of the substrate 201 and CTE of the bonding layer 207 facilitates formation of a CMP pad conditioner having improved geometric characteristics, including for example, improved flatness in the form of low bow and warp, and additionally reduced defects such as cracking or delamination. In accordance with one particular embodiment, the difference between the CTE of the substrate and the CTE of the bonding layer is not greater than about 5 microns/m° C. In accordance with other embodiments, the CTE mismatch may be less, such as on the order or not greater than about 3 microns/m° C., not greater than about 2 microns/m° C., or even not greater than about 1 micron/m° C. Certain embodiments utilize a matching between the substrate 201 and the bonding layer 207 such that the difference in the CTE between each of these components is within a range between about 0.1 microns/m° C. and about 5 microns/m° C., such as between about 0.1 microns/m° C. and about 2 microns/m° C., and more particularly, within a range between about 0.1 microns/m° C. and about 1 microns/m° C.

The bonding layer 207 can have a thickness that facilitates efficient formation of the CMP pad conditioner 200, reduces physical deformation during processing, while being sufficient to secure the abrasive grains therein. As such, it has been found that the bonding layer 207 can have an average thickness that is at least half of the average size of the abrasive grains 209. Accordingly, in one embodiment, the bonding layer 207 has an average thickness that is not greater than about 1 mm. In other embodiments, the bonding layer 207 can have an average thickness that is less, such as not greater than about 100 microns, not greater than about 50 microns, or even not greater than about 20 microns. In accordance with a particular embodiment, the bonding layer 207 has an average thickness within a range between about 10 microns and about 100 microns, and more particularly within a range between about 25 microns and about 75 microns.

The CMP pad conditioner 200 has a bonding layer that extends across the entire upper surface 204 of the substrate 201. Such an arrangement may be used in certain instances because of the thickness of the bonding layer 207 and the manner in which the frit-containing material is applied, for example, those embodiments utilizing a tape or paste. Notably, such arrangements utilize a substrate 201 that has a simple shape (i.e., a disc), as opposed to substrates that use complex shapes, such as having rims along the periphery.

As further illustrated in FIG. 2, an upper plane 211 is shown as a plane defined by the upper surface of the bonding layer 207. As illustrated (and exaggerated for emphasis), the upper plane 211 is illustrated as having a slight convex curvature, wherein the thickness of the bonding layer 207 in the middle of the conditioner is greater than the thickness of the bonding layer 207 at the edges. Notably however, the CMP pad conditioners herein have improved flatness as compared to conventional devices, thus providing more uniform conditioning and having an improved lifetime. As such, in one embodiment, the upper plane 211 has a flatness of less than about 50 microns as compared to a reference plane. In accordance with other embodiments, the upper plane 211 has a flatness of less than about 30 microns, such as less than about 20 microns, and more particularly a flatness within a range between about 0.1 microns and about 50 microns. Such flatness dimensions are measured using a non-contact optical measuring method using various wavelengths of light to calculate distances along the surface and generate a map of the flatness of the sample.

As illustrated in FIG. 2, the CMP pad conditioner 200 includes abrasive grains 209 contained in and bonded to the bonding layer 207. As further illustrated in FIG. 2, the CMP pad conditioner has a defined lower working surface 213 generally defined by a plane extending through the upper most surfaces of the abrasive grains set at the lowest height above the surface of the bonding layer 207. The CMP pad conditioner of FIG. 2 further illustrates an upper working surface 215 defined by a plane extending through the upper most surfaces of the abrasive grains set at the greatest height above the surface of the bonding layer 207. The difference between the lower working surface 213 and upper working surface 215 is the working surface distortion height 217 (Ah), which is primarily a result of a non-planar upper plane 211 that is further amplified by differences in grain sizes of the abrasive grains 209. Notably, the present CMP pad conditioner has a reduced working surface distortion height 217, as the upper plane 211 has superior flatness.

Figure 3:
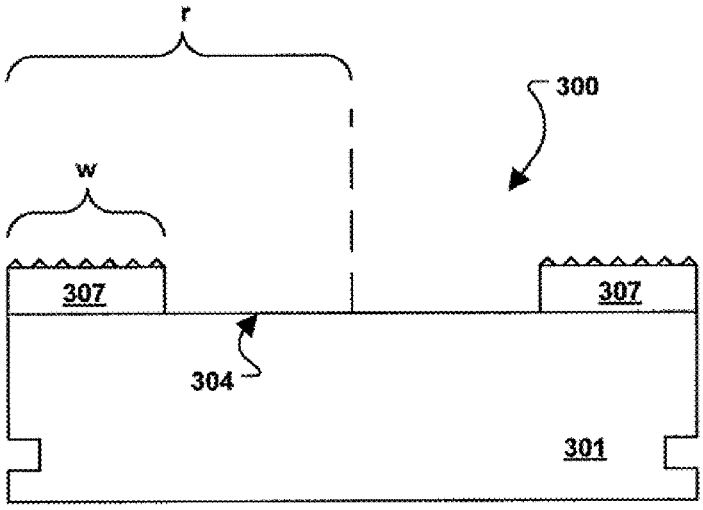
FIG. 3 includes a cross-sectional illustration of a CMP pad conditioner in accordance with an embodiment.

FIG. 3 includes a cross-sectional illustration of a CMP pad conditioner in accordance with one embodiment. The arrangement of the bonding layer 307 and abrasive grains 309 on the substrate 301 is different than illustrated in FIG. 2. As such, the bonding layer 307 does not necessarily overly the entire top surface 304 of the substrate 301. More particularly, as illustrated in FIG. 3, the bonding layer 307 can overlie a portion of the upper surface 304 of the substrate 301 proximate to the edges of the substrate 301, such that the bonding layer 307 is in the shape of an annulus. In such embodiments, the width (w) of the bonding layer 307 along the top surface 304 is less than about 50% of the radius (r) of the substrate. In certain other examples, the width (w) is less, such as less than about 40%, less than about 30%, and particularly within a range between about 10% and about 40%.

Figure 4:
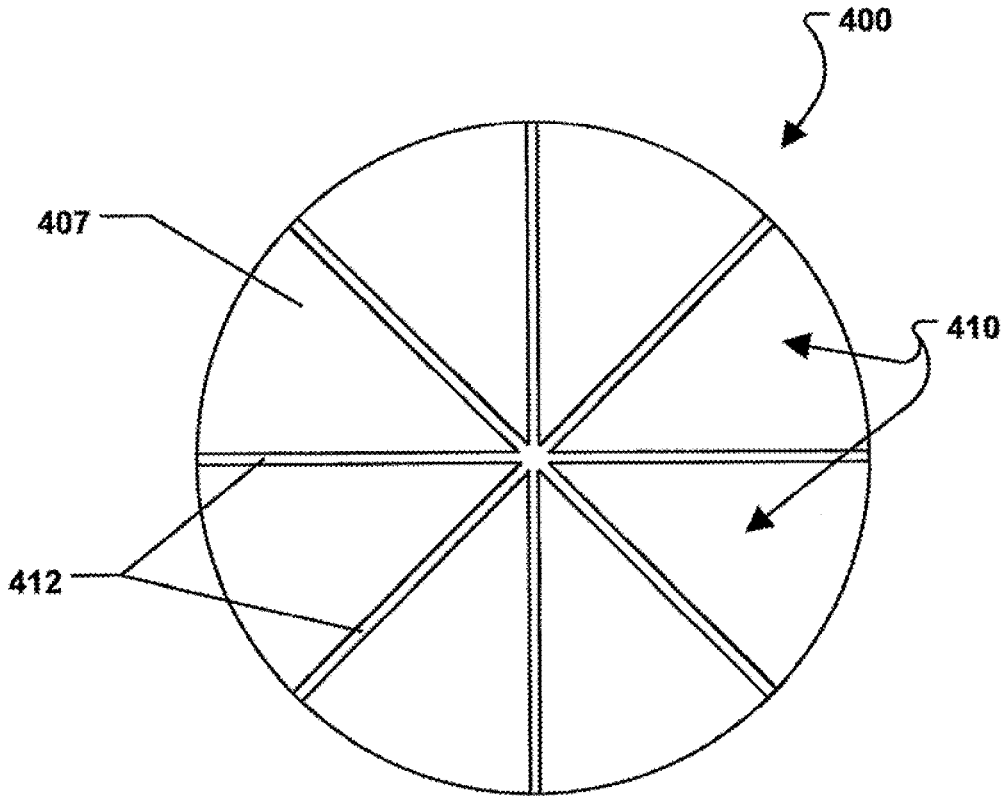
FIG. 4 includes a plan view illustration of a CMP pad conditioner in accordance with an embodiment.

FIG. 4 includes a top view of a CMP pad conditioner in accordance with an embodiment. In particular, the CMP pad conditioner 400 has a different orientation of the bonding layer 407 than previously illustrated embodiments. In particular, the conditioner 400 utilizes a bonding layer 407 that is segmented into sectors 410 along the surface of the substrate. The sectors 410 are separated by channels 412 in which there is no bonding layer 407 overlying the substrate. Channels 412 provide avenues for fluid and particle flow during operation which helps keep the surface of the conditioner 400 clean and can extend the lifetime of the conditioner and pad. It will be appreciated, that the arrangement of the bonding layer 407 on the substrate can be altered to have differently shaped segments and channels.

The channels 412 are formed such that they are of sufficient width to remove liquid and other materials without become easily clogged. In accordance one embodiment, the channels 412 have an average width that is less than about 5 mm. In certain other embodiments, the average width of the channels 412 is less, such as not greater than about 4 mm, not greater than about 3 mm, and particularly within a range between 0.5 mm and about 5 mm.

EXAMPLE 1

The following example provides a detailed method of forming a CMP pad conditioner in accordance with an embodiment. A substrate was in the shape of a disc approximately 10 cm in diameter and approximately 8 mm thick made of transparent fused quartz, made available from Saint-Gobain Quartz as TSC grade fused quartz.

After grinding and polishing the fused silica substrate, the upper surface was cleaned and a frit-containing material in the form of a borosilicate glass tape G-1015 Glass Transfer Tape commercially available from Vitta Corporation as was applied to the fused silica substrate. After suitably placing the glass tape over a major surface of the fused silica substrate, abrasive grains of diamond were placed in an ordered array within the glass tape. The diamonds were provided by Diamond Innovations LLC, grade MBG-640 and had average grain sizes between 325 to 400 meshes.

The as-formed and unfired substrate, glass tape, and abrasive grains were placed in a furnace and heated from room temperature to a forming temperature 950° C. at a heating rate of 10° C./minute. The substrate, glass tape, and abrasive grains were held at the forming temperature for a duration of 60 minutes in an inert gas atmosphere of primarily argon. After sufficient heating, the article was cooled down at a rate of approximately 5° C./minute until room temperature was reached and the final-formed CMP pad conditioner was made.

EXAMPLE 2

The following example provides a detailed method of forming a CMP pad conditioner in accordance with an embodiment. A substrate formed essentially of polycrystalline alumina (at least about 96 wt % alumina) was obtained from Accumet Engineering Corporation in the shape of a disc approximately 10 cm in diameter and approximately 3 mm thick. The CTE of the substrate was approximately 7.5 microns/m° C.

After grinding and polishing the substrate surface, the upper surface was cleaned and a bonding material formed from a frit-containing material in the form of a glass tape material, commercially available from Specialty Glass, Inc, as product Non-Leaded Glass 2 was applied to the surface of the substrate. The CTE of the bonding material was approximately 7.1 microns/m° C.

Abrasive grains having a diamond core material and a titanium coating material were applied to the bonding material in a self avoiding random distribution (SARD™) arrangement. The diamonds were provided by Diamond Innovations LLC, grade MBG-640Ti and the size of the abrasive grains varied from 20 microns to 250 microns.

After placing the abrasive grains on the bonding material, the article was heat treated in a furnace and heated from room temperature to a forming temperature between about 650° C. to 1000° C., obtained at a heating rate between 1° C./min and 10° C./min. The article was held at the forming temperature for a duration of 240 minutes in air. After sufficient heating, the article was cooled down at a rate of approximately 5° C./minute until room temperature was reached and the final-formed CMP pad conditioner was made.

The final-formed CMP conditioner, demonstrated a total flatness of approximately 23 microns and a waviness of approximately 3 microns over a length across the total surface of the article as measured via Micromeasure machine utilizing a non-contact optical measuring method using various wavelengths of light to calculate distances along the surface and generate a map of the flatness of the sample.

Notably, in the formation of certain conventional CMP pad conditioners, additional processing is necessary after heat treatment to curb the physical deformation that has occurred due to heating. Such processes can include pressing the conditioner to reduce warping or bowing, or alternatively some manufacturers may use a glass bead blasting operation to reduce distortion. By contrast, the method of forming the CMP pad conditioner disclosed herein is absent such post-forming operations, because the as-formed conditioner has little physical deformation.

The presently described CMP pad conditioners represent a departure from the state of the art. Inventor recognize that some conditioners have utilized ceramic substrates, and some have suggested the use of a non-metallic bonding material (see, for example WO2004/086477), but such articles are focused on utilizing strong, polycrystalline ceramic materials in the substrate and bonding material, preferably materials such as alumina or silicon carbide. Such conventional conditioners suggest use of a non-metal bond such that the bonding layer is more resistant to the variety of chemicals used in conventional CMP processing. However, the CMP pad conditioner of the present disclosure use a combination of features not realized by such conventional articles. In particular, the CMP pad conditioner utilizes a substrate having a polycrystalline phase, an amorphous or glassy phase, or a combination thereof (i.e., a glass-ceramic material) and in particular instances a transparent substrate for improved CMP operational control and adapted to different monitoring techniques. Additionally, the bonding layer of the presently disclosed CMP pad conditioner utilizes a unique composition and thickness to improve the forming process, which further results in a CMP pad conditioner having improved geometric features. In particular, the combination of features disclosed herein facilitate the formation of a CMP pad conditioner having an exceptionally flat upper plane and a minimized working plane distortion height allowing improved conditioning of CMP pads and an improved lifetime of the conditioner article and CMP pads.

While the invention has been illustrated and described in the context of specific embodiments, it is not intended to be limited to the details shown, since various modifications and substitutions can be made without departing in any way from the scope. For example, additional or equivalent substitutes can be provided and additional or equivalent production steps can be employed. As such, further modifications and equivalents of the invention herein disclosed may occur to persons skilled in the art using no more than routine experimentation, and all such modifications and equivalents are believed to be within the scope of the invention as defined by the following claims.

The Abstract of the Disclosure is provided to comply with 37 C.F.R. §1.72(b) and is submitted with the understanding that it will not be used to interpret or limit the scope or meaning of the claims. In addition, in the foregoing Detailed Description of the Drawings, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all features of any of the disclosed embodiments. Thus, the following claims are incorporated into the Detailed Description of the Drawings, with each claim standing on its own as defining separately claimed subject matter.

What is claimed is:

1. A CMP pad conditioner comprising:

a substrate comprising fused silica, wherein the substrate further comprises an amorphous phase extending through the entire thickness of the substrate;

a bonding layer comprising a vitreous material overlying and bonded to a major surface of the substrate, wherein an upper surface of the bonding layer defines an upper plane having a flatness of less than about 50 microns as compared to a reference plane; and abrasive grains contained within the vitreous bond layer, and wherein the major surface of the substrate and a back surface of the substrate have a parallelism of less than 10 arc minutes.

2. The CMP pad conditioner of claim 1, wherein the flatness is less than about 30 microns.

3. The CMP pad conditioner of claim 1, wherein the substrate has a coefficient of thermal expansion (CTE) and the bonding layer has a CTE, and the difference between the CTE of the substrate and the CTE of the bonding layer is not greater than about 5 microns/m° C.

4. The CMP pad conditioner of claim 1, wherein the abrasive grains are positioned within the bonding layer to form a pattern.

5. The CMP pad conditioner of claim 1, wherein the abrasive grains are selected from the group of abrasive grains consisting of oxides, carbides, and nitrides.

6. The CMP pad conditioner of claim 5, wherein the abrasive grains are selected from the group of abrasive grains consisting of cubic boron nitride and diamond.

7. The CMP pad conditioner of claim 1, wherein the abrasive grains have an average grain size of not greater than about 200 microns.

8. The CMP pad conditioner of claim 1, wherein the bonding layer comprises boron oxide.

9. The CMP pad conditioner of claim 8, wherein the bonding layer comprises not greater than about 20 wt % boron oxide.

10. A CMP pad conditioner comprising:

a substrate comprising fused silica and an amorphous phase extending through the entire thickness of the substrate, wherein the substrate further comprises a transparency window having an average internal transmittance of at least about 90%;

a bonding layer comprising a vitreous material overlying and bonded to a major surface of the substrate, wherein an upper surface of the bonding layer defines an upper plane having a flatness of less than about 50 microns as compared to a reference plane; and abrasive grains contained within the bonding layer, wherein the abrasive grains comprise a core material and a coating overlying the core material, and wherein the major surface of the substrate and a back surface of the substrate have a parallelism of less than 10 arc minutes.

11. The CMP pad conditioner of claim 10, wherein the core material comprises a superabrasive material.

12. The CMP pad conditioner of claim 10, wherein the coating comprises a metal or metal alloy.

13. The CMP pad conditioner of claim 12, wherein the coating comprises titanium.

14. The CMP pad conditioner of claim 10, wherein the bonding layer comprises boron oxide.

15. The CMP pad conditioner of claim 10, wherein the average internal transmittance of at least about 90% is over a wavelength range extending from about 400 nm to about 500 nm along a path length extending through the substrate of not less than about 10 mm.

16. The CMP pad conditioner of claim 10, wherein the substrate comprises a rear surface spaced apart from and co-planar with a top surface, and sides joining the rear surface and top surface, wherein the top surface defines the major surface.

17. The CMP pad conditioner of claim 16, wherein the substrate comprises openings within the sides.

* * * * *